US006729309B2

(12) United States Patent
Schueler

(10) Patent No.: US 6,729,309 B2
(45) Date of Patent: May 4, 2004

(54) FUEL-INJECTION SYSTEM COMPRISING PRESSURE REGULATION IN THE RETURN LINE

(75) Inventor: Peter Schueler, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/221,147

(22) PCT Filed: Dec. 19, 2001

(86) PCT No.: PCT/DE01/04795

§ 371 (c)(1),
(2), (4) Date: Dec. 26, 2002

(87) PCT Pub. No.: WO02/055873

PCT Pub. Date: Jul. 18, 2002

(65) Prior Publication Data

US 2003/0111050 A1 Jun. 19, 2003

(30) Foreign Application Priority Data

Jan. 10, 2001 (DE) ..... 101 00 700

(51) Int. Cl.[7] ..... F02M 33/04
(52) U.S. Cl. ..... 123/514; 123/446
(58) Field of Search ..... 123/510, 511, 123/514, 59, 446.7

(56) References Cited

U.S. PATENT DOCUMENTS

| | | | | |
|---|---|---|---|---|
| 6,234,151 | B1 * | 5/2001 | Eck | 123/514 |
| 6,345,608 | B1 * | 2/2002 | Rembold et al. | 123/506 |
| 6,615,806 | B2 * | 9/2003 | Schueler | 123/514 |
| 2002/0124834 | A1 * | 9/2002 | Rembold et al. | 123/514 |

FOREIGN PATENT DOCUMENTS

| | | |
|---|---|---|
| DE | 35 00 718 A | 7/1986 |
| DE | 198 45 556 A | 4/2000 |
| DE | 198 46 157 A | 4/2000 |
| EP | 0 886 056 A | 12/1998 |
| EP | 1 209 349 A | 5/2002 |

* cited by examiner

*Primary Examiner*—Thomas N. Moulis
(74) *Attorney, Agent, or Firm*—Ronald E. Greigg

(57) ABSTRACT

A common rail fuel injection system in which the pressure in the return line is controlled as a function of the delivery pressure of the presupply pump. This improves the operating behavior of a high-pressure fuel pump and the injectors which are supplied with fuel by means of a common rail. The pressure in the return line is controlled by means of a pressure control valve.

20 Claims, 4 Drawing Sheets

FUEL-INJECTION SYSTEM COMPRISING PRESSURE REGULATION IN THE RETURN LINE

CROSS-REFERENCE TO RELATED APPLICATIONS

This application is a 35 UCS 371 application of PCT/DE 01/04795, filed on Dec. 19, 2001.

BACKGROUND OF THE INVENTION

1. Field of the Invention

The invention relates to a fuel injection system for internal combustion engines, with a high-pressure fuel pump, a common rail, at least one injector, and a presupply pump, in which the high-pressure fuel pump supplies fuel to the injector(s) by means of the common rail, with a control of the delivery pressure of the presupply pump, with a return line for conveying fuel away from the injector(s) and/or from the high-pressure fuel pump, and with a pressure control in the return line.

2. Description of the Prior Art

The operating behavior of injectors, of the pressure control of the common rail, and of the high-pressure pump of common rail fuel injection systems depend among other things on the back pressure in the return line. Therefore, in the known fuel injection systems, the pressure in the return line is controlled by pressure-holding valves inserted into the return line or by a pressure control valve connected in parallel to a tank jet pump in the fuel tank. These pressure controls depend on the ambient pressure and the fuel return, which is in turn a function of the operating point of the internal combustion engine.

The object of the invention is to achieve a pressure control in the return line with improved control performance.

This object is attained according to the invention by means of a fuel injection system for internal combustion engines with a high-pressure fuel pump, a common rail, at least one injector, and a presupply pump, in which system the high-pressure fuel pump supplies the injector(s) with fuel by means of the common rail, the presupply pump delivers fuel from a tank to the high-pressure fuel pump, with a control of the delivery pressure of the presupply pump. A return line conveys fuel away from the injector(s) and/or from the high-pressure fuel pump, and a pressure control in the return line controls pressure in the return line as a function of the delivery pressure of the presupply pump.

SUMMARY OF THE INVENTION

In this fuel injection system, the pressure maintenance in the return line is improved by virtue of the fact that the delivery pressure of the presupply pump is used as a reference value for the pressure control in the return line. Since the delivery pressure of the presupply pump is controlled, the control performance of the pressure in the return line is also improved.

In a modification of the invention, the delivery pressure of the presupply pump is controlled to an absolute value so that the control of pressure in the return line is also independent of the ambient pressure and an improvement in the control performance is consequently achieved.

Another modification of the invention includes the provision that the presupply pump is disposed in the tank. A tank jet pump for filling a collection cup is provided in the tank, and that the return line drives the tank jet pump. In this embodiment, the presupply pump is driven independently of the high-pressure fuel pump and can therefore be better controlled. As a result, the pressure in the pressure region of the presupply pump is kept constant to a better degree, which has an advantageous effect on the control performance of the pressure in the return line.

In another modification of the invention, the pressure control valve has at least one inlet, an outlet, and a control pressure connection and the control pressure connection is hydraulically connected to the pressure side of the presupply pump so that the control performance of the pressure in the return line is improved in the manner according to the invention.

One embodiment of the invention also includes the provision that the pressure control valve is embodied as a sliding valve, that one end of the slider is subjected to the delivery pressure of the presupply pump, that a second end of the slider is subjected to the pressure of the return line and the force of a control spring, and that depending on the position of the slider, the outlet of the pressure control valve is unblocked so that the pressure in the return line can be controlled in a simple manner. The sensitive reaction behavior of slide valves permits particularly high control performance to be achieved.

Another embodiment of the invention includes the provision that the pressure control valve is embodied as a seat valve with a diaphragm and valve body, that a first side of the diaphragm is subjected to the delivery pressure of the presupply pump, that a second side of the diaphragm is also subjected to the pressure of the return line and the force of a control spring, and that depending on the position of the diaphragm, the valve body for a valve seat is lifted up and the outlet of the pressure control valve is unblocked so that due to the size of the diaphragm, even extremely small pressure changes trigger a control action and consequently, a high control performance is achieved.

The valve body can be embodied as a ball or a valve cone so that the specific advantages of these valve bodies can also be used for a fuel injection system according to the invention.

BRIEF DESCRIPTION OF THE DRAWINGS

Other advantages and features of the invention will become apparent from the description contained herein below, taken in conjunction with the drawings, in which.

DESCRIPTION OF THE PREFERRED EMBODIMENTS

Figure 1:
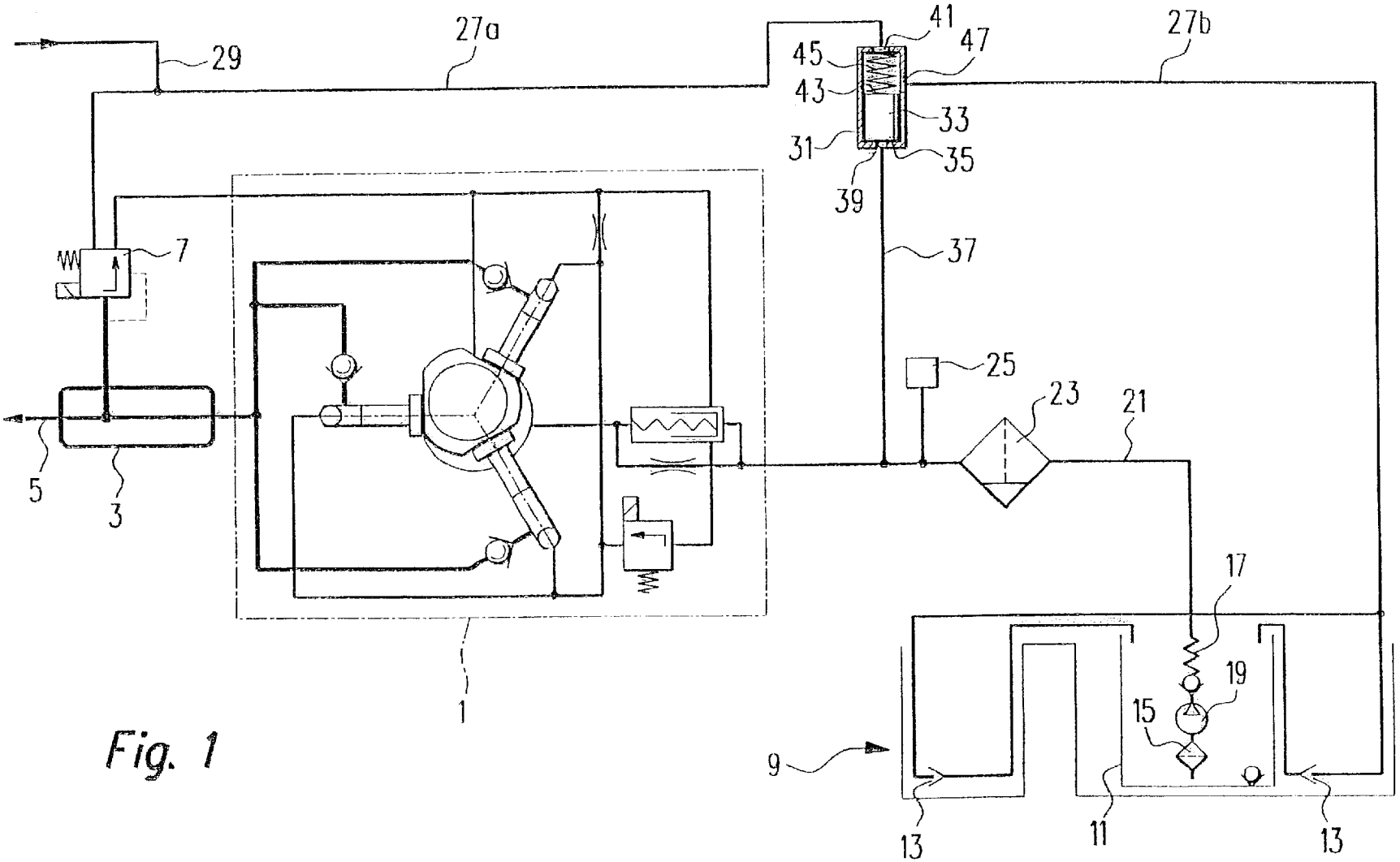
FIG. 1 shows a first exemplary embodiment of a fuel injection system according to the invention in a neutral position.

FIG. 1 is a schematic depiction of a first exemplary embodiment of a fuel injection system according to the invention. A high-pressure fuel pump 1, which is not explained in detail, delivers fuel into the common rail 3. The common rail 3 supplies injectors, not shown, with fuel via connecting lines 5. The pressure in the common rail 3 is controlled by means of a pressure-holding valve 7.

The high-pressure fuel pump 1 is supplied by means of a supply line 21 with fuel from a tank 9 with a collection cup 11, several tank jet pumps 13, a preliminary filter 15, a check valve 17, and an electric presupply pump 19. The supply line 21 contains a fuel filter 23 with a water separator and an absolute pressure center 25. The measurement values of the absolute pressure sensor 25 are transmitted to a control unit, not shown, which controls the presupply pump 19 as a function of the pressure measured in the supply line 21 so that a constant absolute pressure prevails in the supply line 21. The supply line 21 is subjected to the delivery pressure of the presupply pump 19.

The tank jet pumps 13 are driven by the fuel that flows through a return line 27 from the common rail 3 and the overflow lines 29 of the injectors, not shown, and back into the tank 9. A pressure control valve 31 divides the return line 27 into two sections 27*a* and 27*b*. For the function of the injectors, not shown, and the high-pressure fuel pump 1, it is important that the pressure in the section 27*a* to the return line 27 be constant.

The pressure control valve 31 in the exemplary embodiment according to FIG. 1 is embodied as a sliding valve. By means of a connecting line 37, a first end 35 of a slider 33 is subjected to the pressure in the supply line 21, which corresponds to the delivery pressure of the presupply pump 19. The connecting line 37 feeds into a control pressure connection of the pressure control valve 31. At the end of the pressure control valve 31 oriented away from the control pressure connection 39, an inlet 41 is provided into which the section 27*a* of the return line feeds. That is, a second end 43 of the slider 33 is subjected to the pressure of the fuel in the section 27*a* of the return line 27. The force of a control spring 45, which is supported against the second end 43 and the housing of the control valve 31, also acts on the second end 43.

In the position of the slider 33 shown in FIG. 1, it unblocks an outlet 47 to which the section 27*b* of the return line is connected.

The pressure in the section 27*a* is consequently essentially determined by the flow resistance of the pressure control valve 31 and the tank jet pumps 13. The flow resistance of the tank jet pumps 13, which depends on the ambient pressure, consequently gives the pressure in the section 27*a* of the return line a slightly proportional characteristic curve.

Figure 2:
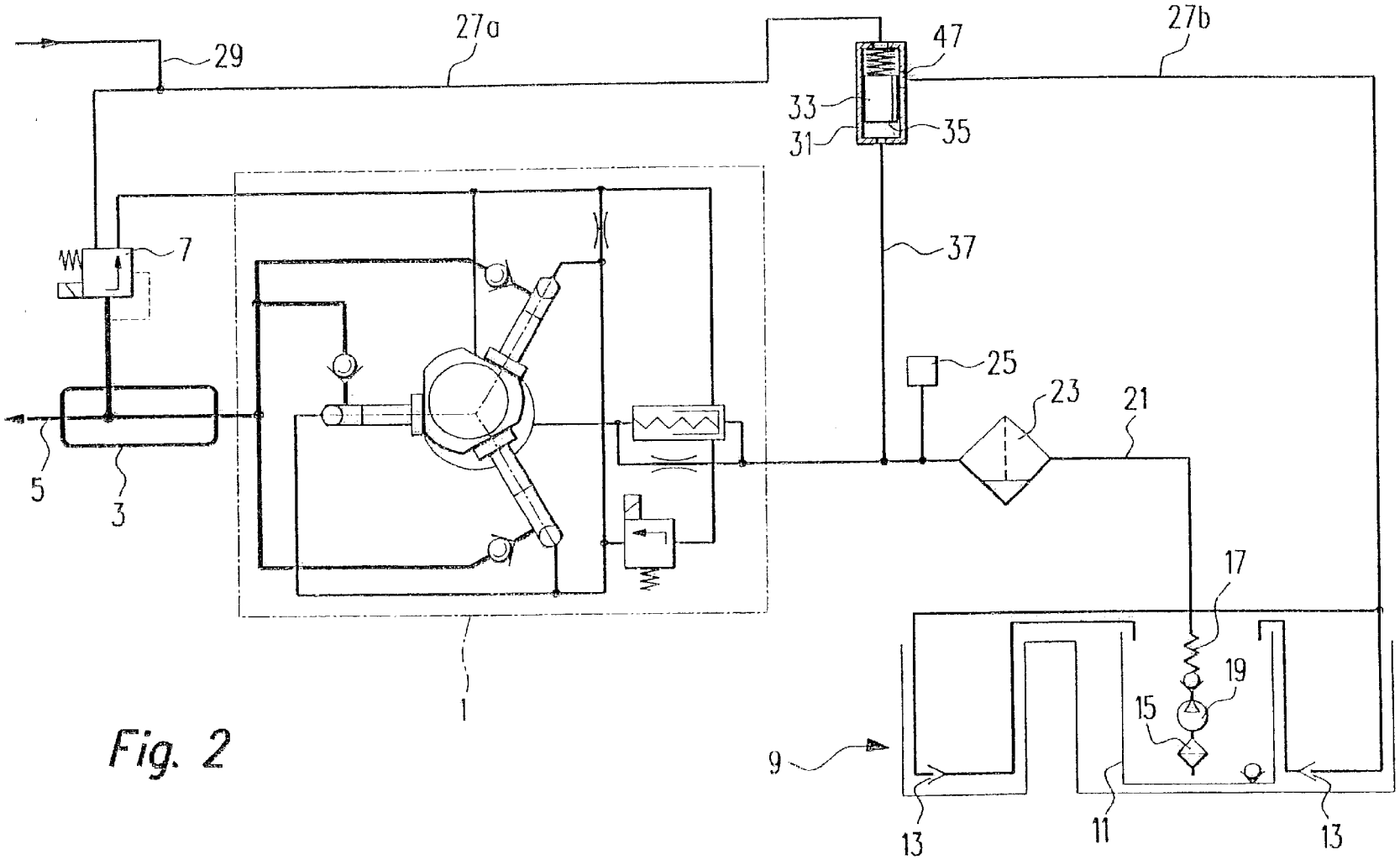
FIG. 2 shows the exemplary embodiment according to FIG. 1 in a control position.

FIG. 2 shows the pressure control valve 31 in a control position. For the sake of clarity, not all components of the pressure control valve have been provided with reference numerals. In the position of the slider 33 shown in FIG. 2, the second end 43 of this slider 33 partially closes the outlet 47. The control pressure from the supply line 21 acting on the first end 35 of the slider 33 lifts the slider up counter to the force of the control spring 45 and the pressure on the second end 43. As a result, the flow resistance of the pressure control valve 31 increases in comparison to the neutral position shown in FIG. 1.

Figure 3:
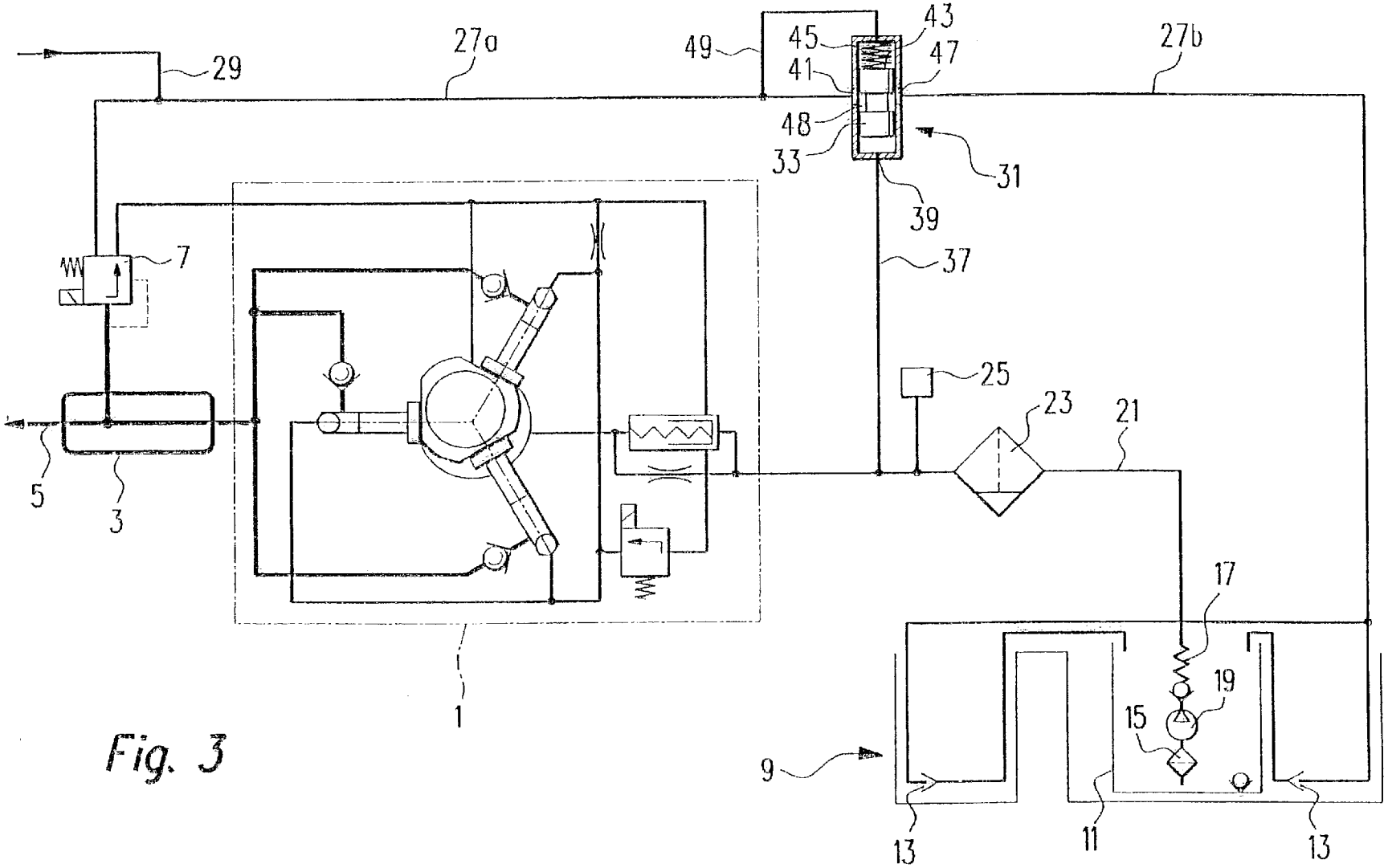
FIG. 3 shows a second exemplary embodiment of a fuel injection system according to the invention.

In the exemplary embodiment according to FIG. 3, the inlet 41 and outlet 47 are dispose on opposite sides. The slider 33 has an annular groove 48, which in the neutral position shown in FIG. 3 more or less unblocks the inlet 41 and outlet 47. The pressure of the section 27*a* of the return line is conveyed via a separate control line 49 into the chamber defined by the second end 43 of the slider 33. The inlet 41 and outlet 47 can also be somewhat offset from each other so that initially, for example, the inlet is unblocked by the annular groove 48 and then the outlet 47 is unblocked. This measure permits influence to be exerted on the operating behavior of the pressure control valve 31.

Figure 4:
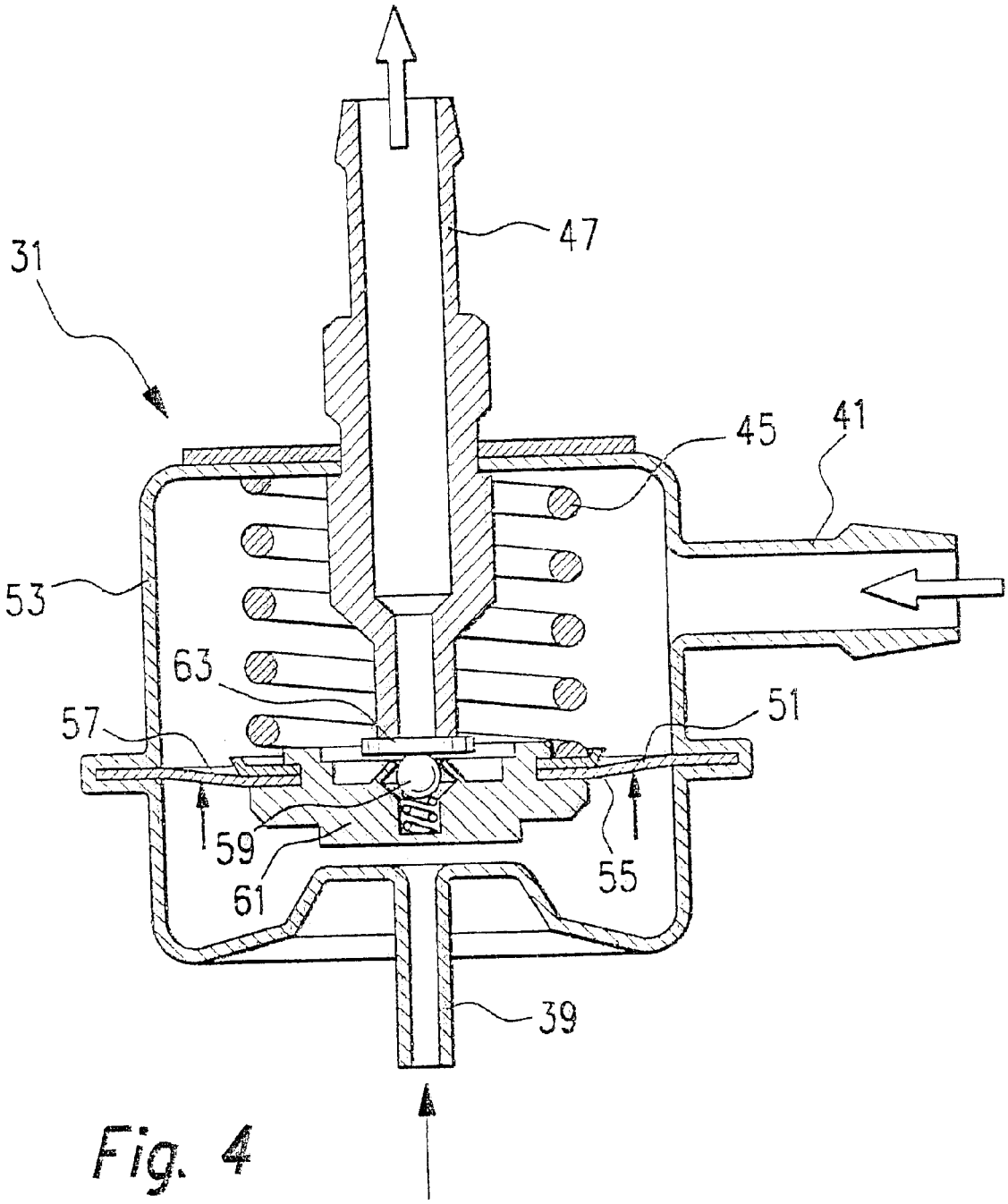
FIG. 4 shows a pressure control valve embodied as a diaphragm valve.

FIG. 4 shows a pressure control valve 31 embodied as a diaphragm valve. A diaphragm 51 divides the space enclosed by a housing 53 into two partial chambers. By means of the control pressure connection 39, a first side 55 of the diaphragm 51 is subjected to the pressure in the supply line 21, or the delivery pressure of the presupply pump 19 (neither shown). A second side 57 of the diaphragm is subjected to the action of a control spring 45 and the pressure of the fuel flowing in the inlet 41. In the position shown, a valve body 59 embodied as a ball, which is secured in an insert 61 of the diaphragm 51, is pressed against a valve seat 63, which closes the outlet 47. As soon as a control spring 45 and the fuel pressure acting on the second side 57 of the diaphragm 51 lift the valve body 59 up from the valve seat 63, the outlet 47 is unblocked and the pressure in the inlet 41 decreases. The inlet 41, as can be seen in FIGS. 1 to 3, is connected to the first section 27*a* of the return line.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system for internal combustion engines, with a high-pressure fuel pump (1), a common rail (3), and at least one injector, the high-pressure fuel pump (1) supplying fuel to the injector(s) by means of the common rail (3), with a presupply pump (19) that delivers fuel from a tank (9) to the high-pressure fuel pump (1), with a pressure control of the delivery pressure of the presupply pump (19), with a return line (27) for conveying fuel away from the injector(s) and/or from the high-pressure fuel pump (1), and with a pressure control in the return line (27), the improvement comprising control means controlling the pressure in the return line (27) as a function of the delivery pressure of the presupply pump (19).

2. The fuel injection system according to claim 1 further comprising means for controlling the delivery pressure of the presupply pump (19) is controlled to an absolute value.

3. The fuel injection system according to claim 1 wherein the presupply pump (19) is disposed in the tank (9), the system further comprising at least one tank jet pump (13) for filling a threshold cup (11) in the tank (9), the at least one tank jet pump (13) being driven by the fuel flowing in the return line (27).

4. The fuel injection system according to claim 2 wherein the presupply pump (19) is disposed in the tank (9), the system further comprising at least one tank jet pump (13) for filling a threshold cup (11) in the tank (9), the at least one tank jet pump (13) being driven by the fuel flowing in the return line (27).

5. The fuel injection system according to claim 1 wherein the pressure control valve (31) has at least one inlet (41), one outlet (47), and a control pressure connection (39), the control pressure connection (39) being hydraulically connected to the pressure side of the presupply pump (1).

6. The fuel injection system according to claim 2 wherein the pressure control valve (31) has at least one inlet (41), one outlet (47), and a control pressure connection (39), the control pressure connection (39) being hydraulically connected to the pressure side of the presupply pump (1).

7. The fuel injection system according to claim 3 wherein the pressure control valve (31) has at least one inlet (41), one outlet (47), and a control pressure connection (39), the control pressure connection (39) being hydraulically connected to the pressure side of the presupply pump (1).

8. The fuel injection system according to claim 5 wherein the pressure control valve (31) has at least one inlet (41), one outlet (47), and a control pressure connection (39), the control pressure connection (39) being hydraulically connected to the pressure side of the presupply pump (1).

9. The fuel injection system according to claim 5 wherein the pressure control valve (31) is embodied as a sliding valve, having a first end (35) subjected to the delivery pressure of the presupply pump (19) and a second end (43) subjected to the pressure of the return line (27*a*) and the force of a control spring (45), and wherein the outlet (47) of the pressure control valve (31) is unblocked as a function of the position of the slider (33).

10. The fuel injection system according to claim 6 wherein the pressure control valve (31) is embodied as a sliding valve, having a first end (35) subjected to the delivery pressure of the presupply pump (19) and a second end (43) subjected to the pressure of the return line (27*a*) and the force of a control spring (45), and wherein the outlet (47) of the pressure control valve (31) is unblocked as a function of the position of the slider (33).

11. The fuel injection system according to claim 7 wherein the pressure control valve (31) is embodied as a sliding valve, having a first end (35) subjected to the delivery pressure of the presupply pump (19) and a second end (43) subjected to the pressure of the return line (27*a*) and the force of a control spring (45), and wherein the outlet (47) of the pressure control valve (31) is unblocked as a function of the position of the slider (33).

12. The fuel injection system according to claim 8 wherein the pressure control valve (31) is embodied as a sliding valve, having a first end (35) subjected to the delivery pressure of the presupply pump (19) and a second end (43) subjected to the pressure of the return line (27*a*) and the force of a control spring (45), and wherein the outlet (47) of the pressure control valve (31) is unblocked as a function of the position of the slider (33).

13. The fuel injection system according to claim 5 wherein the pressure control valve (31) is embodied as a seat valve having a diaphragm (51) and a valve body (59), and having a first side (55) subjected to the delivery pressure of the presupply pump (19) and a second side (57) subjected to the pressure of the return line (27*a*) and the force of a control spring (45), and wherein the valve body (59) is lifted up from a valve seat (63) and the outlet (47) of the pressure control valve (31) is unblocked as a function of the position of the diaphragm (51).

14. The fuel injection system according to claim 6 wherein the pressure control valve (31) is embodied as a seat valve having a diaphragm (51) and a valve body (59), and having a first side (55) subjected to the delivery pressure of the presupply pump (19) and a second side (57) subjected to the pressure of the return line (27*a*) and the force of a control spring (45), and wherein the valve body (59) is lifted up from a valve seat (63) and the outlet (47) of the pressure control valve (31) is unblocked as a function of the position of the diaphragm (51).

15. The fuel injection system according to claim 7 wherein the pressure control valve (31) is embodied as a seat valve having a diaphragm (51) and a valve body (59), and having a first side (55) subjected to the delivery pressure of the presupply pump (19) and a second side (57) subjected to the pressure of the return line (27*a*) and the force of a control spring (45), and wherein the valve body (59) is lifted up from a valve seat (63) and the outlet (47) of the pressure control valve (31) is unblocked as a function of the position of the diaphragm (51).

16. The fuel injection system according to claim 8 wherein the pressure control valve (31) is embodied as a seat valve having a diaphragm (51) and a valve body (59), and having a first side (55) subjected to the delivery pressure of the presupply pump (19) and a second side (57) subjected to the pressure of the return line (27*a*) and the force of a control spring (45), and wherein the valve body (59) is lifted up from a valve seat (63) and the outlet (47) of the pressure control valve (31) is unblocked as a function of the position of the diaphragm (51).

17. The fuel injection system according to claim 13 wherein the valve body (59) is a ball or a valve cone.

18. The fuel injection system according to claim 6 wherein the valve body (59) is a ball or a valve cone.

19. The fuel injection system according to claim 7 wherein the valve body (59) is a ball or a valve cone.

20. The fuel injection system according to claim 8 wherein the valve body (59) is a ball or a valve cone.

* * * * *